United States Patent [19]

Baur

[11] 4,151,102

[45] Apr. 24, 1979

[54] SYNTHETIC BEARING LUBRICANT

[75] Inventor: Rudolf Baur, Kreuzlingen, Switzerland

[73] Assignee: Swiss Aluminium Ltd., Chippis, Switzerland

[21] Appl. No.: 909,791

[22] Filed: May 26, 1978

[30] Foreign Application Priority Data

Jun. 2, 1977 [CH] Switzerland ..... 6767/77

[51] Int. Cl.[2] ..... C10M 1/26; C10M 1/16

[52] U.S. Cl. ..... 252/56 R; 252/59

[58] Field of Search ..... 252/56 R, 59

[56] References Cited

U.S. PATENT DOCUMENTS

| | | | |
|---|---|---|---|
| 2,774,733 | 12/1956 | Williams et al. | 252/56 R |
| 2,899,390 | 8/1959 | Plemich | 252/56 R |
| 3,298,951 | 1/1967 | Guminski | 252/56 R |

*Primary Examiner*—W. J. Shine

*Attorney, Agent, or Firm*—Bachman and LaPointe

[57] ABSTRACT

A synthetic bearing lubricant prevents wear even under very high loads and is such that when it contaminates the rolling lubricant the rolled product is not stained. The bearing lubricant contains poly-isobutene, at least one ester of a $C_2$ to $C_5$ alcohol with an $\alpha$-hydroxy-mono carboxylic acid or an $\alpha$-hydroxy-dicarboxylic acid, and at least single or poly unsaturated $C_{13}$ to $C_{19}$ carboxylic acid.

11 Claims, No Drawings

SYNTHETIC BEARING LUBRICANT

The invention concerns a synthetic lubricant for bearings, in particular for highly stressed bearings such as the backing roll bearings of rolling mills.

Metallic foil is produced mostly by cold rolling on a quarto rolling mill. In this rolling process the rolling force is transferred to the two rolls via the upper and lower backing rolls. The resultant large forces are transmitted via the roll axles of the backing rolls to the roll bearings and then to the rolling mill stands. The tribological events which occur during the lubrication of loaded, rotating roll bearings can be described in a simplified manner as follows:

The roll axle made of hard roll steel is embedded in a ring made of soft bearing metal. The bearing with the sealing rings closed towards the roll side is flushed with a lubricant. This facility produces a film of lubricant between the roll axles and the bearing rings. The film of lubricant separates the rotating axles from the bearing rings, prevents contact between the two metal surfaces and transmits the rolling force from the rolls to the stands.

On starting up or slowing down, or when heavy forces are developed in the roll bearings the lubricant film is partly broken with the result that the metallic surfaces of the axles and roll bearings come into contact. In this condition of mixed friction/lubrication the specific extreme pressure additives in the lubricant ensure that no "cold welding" occurs between the two metal surfaces. These additives—specific organic substances dissolved in lubricant oil—react with the metal surface which has been made highly active as a result of the rubbing contact, and produce a reaction layer which prevents metal contact and thus wear on the bearings.

When extremely high loading occurs and the lubricant can no longer prevent direct contact between the metal surfaces, rapid wear of the bearing surfaces occurs due to high frictional forces, metallic fines and the large amount of heat developed. Consequently high temperatures are produced, at which the bearing metal becomes liquid and the self-ignition temperature of the lubricant can be reached.

In foil rolling mills for example the bearing lubricant can be heavy oil derivatives containing lead naphthenic salts as an additive. Leaks in the bearing seals can cause the foil rolling lubricant—normally with palmseed oil (a mixture of natural tri-glycerides) as the pressure component—to be contaminated with roll bearing lubricant. If the concentration of roll bearing lubricant in the foil rolling oil exceeds a certain level, then after the degreasing heat treatment of the rolls of foil, sticky foil will result. When thin strip is given a degreasing heat treatment, then the bearing lubricant in the rolling oil causes brown spots and edges on the surface of the rolled product.

With this in mind the inventor set himself the task of developing a synthetic roll bearing lubricant with which the wear on the roll bearings can be avoided even under very high loads, whereby even large amounts of impurities of the bearing lubricant in the rolling oil do not cause spots on the rolled product after the degreasing heat treatment.

The bearing lubricant of the invention is such that 100 parts by weight of the lubricant contain:

| | |
|---|---|
| 86.9 to 97.5 | parts by weight of polyisobutene |
| 2.1 to 11.2 | parts by weight of at least one ester of a $C_2$ to $C_5$ alcohol with an α-hydroxy-monocarboxylic acid or an α-hydroxy-dicarboxylic acid, and |
| 0.4 to 1.9 | parts by weight of at least one single or multiple-unsaturated $C_{13}$-to $C_{19}$-carboxylic acid. |

Preferably the 100 parts by weight of the lubricant comprises:

| | |
|---|---|
| 91.5 to 95.3 | parts by weight of polyisobutene |
| 3.7 to 7.5 | parts by weight of at least one ester of a $C_2$ to $C_5$ alcohol with an α-hydroxy-carboxylic acid, and |
| 0.6 to 1.2 | parts by weight of at least one unsaturated $C_{13}$–$C_{19}$ carboxylic acid. |

The manufacture of the lubricant takes place simply by mixing the components in accordance with the required composition. The mixing operation can be made easier by warming the viscous components.

Extensive plant trials with various lubricating systems have shown that the lubricant of the invention can be employed to full advantage in all known lubricating systems (e.g. closed circuit systems and various open circuit systems with ball, roller and cone bearings). It has been found particularly advantageous to employ the lubricant of the invention in oil mist and oil droplet/-compressed air lubricating systems. It was found, surprisingly, that the friction which is found to occur with ring bearings on starting up cold, can be avoided to a large extent with the lubricant according to the invention. Trials have shown that the tendency of the rolls to stick can be reduced without impairing the advantages accrued from the invention, if the polyisobutene is completely or partly replaced by polymethyacrylate dissolved in mineral oil, or by a mixture of polymethacrylate and kerosene dissolved in mineral oil. In the latter case the ratio of polymethacrylate solution: kerosene should be approx. 2:1 to 1:2, preferably 1.2:1 to 1:1.2. The kind of mineral oils containing polymethacrylate are commercially available products (e.g. VISCOPLEX SV 36, Röhm GmbH), and are in general used as lubricant additives to lower the stock point and to raise the viscosity index.

The polybutenes used in accordance with the invention to form the hydrodynamic lubricant film are likewise commercially available products e.g. INDOPOL L 10 and INDOPOL H 100 (AMOCO CHEMICALS). The viscosity of the lubricant of the invention can be altered over a relatively large range simply by mixing in polybutenes of various chain lengths. For example by altering the ratio of mixing of the two above mentioned INDOPOLES, at 60° C. a viscosity range of 10 to 5000 cSt can be obtained.

Direct contact between the roll axles and the roll bearings is prevented mainly by the hydrodynamic lubrication effect of the polybutene based lubricant of the invention. This hydrodynamic lubricant film can be broken by heavy loads with the result that wear occurs and in an extreme case could cause cold welding between the axles and the bearings. This can be prevented by the addition, in accordance with the invention, of α-hydroxymonocarboxylic acid esters, which are provided to form a "reaction layer" via tribo-chemical reactions when the hydrodynamic lubricant film is broken. The lubricant additives chosen for this role are therefore denoted as "reaction layer agents".

It has been found that the preferred esters are those whose alcohol component is an alcohol from the following group:

ethanol
propanol
butanol
pentanol and the acid component is an acid from the following group:

hydroxy acetic acid
lactic acid
malic acid
tartaric acid

The following of these possible combinations have been found to be particularly advantageous:

ethanol hydroxy acetate
propanol hydroxy acetate
butanol hydroxy acetate
lactic acid ethyl ester
lactic acid propyl ester
lactic acid butyl ester
malic acid butyl ester
tartaric acid dibutyl ester
3-hydroxy-butyric acid ethyl ester Furthermore it has been found that the rust inhibiting single or poly unsaturated $C_{13}$ to $C_{19}$ carboxylic acid is advantageously of the group:

oleic acid
linoleic acid
linolenic acid.

In order to achieve the optimum properties in the lubricant according to the invention it has been found favorable for the individual components, in particular the esters which form the reaction layer, to be at least of "pure" grade.

The advantages of the bearing lubricant in accordance with the invention will now be explained further with the help of results from a number of investigations.

The compositions of the exemplified embodiments of the lubricants in accordance with the invention, their densities and viscosities are given in table I.

Table I

| Lubricant | Composition | Concentration (parts by weight) | Density | Kinematic viscosity (cSt) 20° C. | 50° C. | 60° C. | 80° C. |
|---|---|---|---|---|---|---|---|
| 4661 | INDOPOL H 100 | 40 | 0.860 | 273 | 50 | 33 | 17 |
| | INDOPOL L 10 | 60 | | | | | |
| | butanol hydroxy acetate | 6 | | | | | |
| | Oleic acid | 1 | | | | | |
| 6461 | INDOPOL H 100 | 60 | 0.869 | 1098 | 138 | 86 | 39 |
| | INDOPOL L 10 | 40 | | | | | |
| | butanol hydroxy acetate | 6 | | | | | |
| | Oleic acid | 1 | | | | | |
| 4662 | INDOPOL H 100 | 40 | 0.860 | 346 | 62 | 51 | 20 |
| | INDOPOL L 10 | 60 | | | | | |
| | lactic acid butylester | 6 | | | | | |
| | oleic acid | 1 | | | | | |
| 4663 | INDOPOL H 100 | 40 | 0.860 | 466 | 77 | 49 | 24 |
| | INDOPOL L 10 | 60 | | | | | |
| | malic acid butylester | 6 | | | | | |
| | oleic acid | 1 | | | | | |
| 4664 | INDOPOL H 100 | 40 | 0.864 | 561 | 85 | 53 | 25 |
| | INDOPOL L 10 | 60 | | | | | |
| | tartaric acid butylester | 6 | | | | | |
| | oleic acid | 1 | | | | | |
| 4665 | INDOPOL H 100 | 40 | 0.858 | 405 | 62 | 40 | 20 |
| | INDOPOL L 10 | 60 | | | | | |
| | 3 hydroxybutyric acid ethylester | 6 | | | | | |
| | oleic acid | 1 | | | | | |
| 4666 | INDOPOL H 100 | 40 | (1) | 709 | 100 | 61 | 27 |
| | INDOPOL L 10 | 60 | | | | | |
| | tartaric acid diethylester | 6 | | | | | |
| | oleic acid | 1 | | | | | |
| 556 V | VISCOPLEX SV 36 | 35 | 0.867 | 707 | 231 | 174 | 109 |
| | butanol hydroxyacetate | 5 | | | | | |
| | oleic acid | 1 | | | | | |
| | petrol | 38 | | | | | |

(1) Tartaric acid-diethylester is only partially soluble in polyisobutene

After the last rolling pass, metallic foils are given a heat treatment partly with the aim of removing residual rolling lubricant from the surface. This heat treatment is carried out either in a furnace with air circulating in it or under nitrogen as a protective atmosphere. Since the rolling lubricant can be contaminated with bearing lubricant during production, as a result of leaks in the roll bearings, the behavior of this lubricant during the heat treatment is of decisive importance, in particular in the production of aluminum foil.

In table II results from tests closely related to actual practice are presented. For comparison purposes conventional lubricants of the following kinds were included in the tests:

Commercially available product A:
Commercially available product B: oil-mist-lubricant
Commercially available product C: gear lubricating oil
Commercially available product D: gear lubricating oil.

Heat treatment test No. 1 is a test in which a drop of lubricant is placed between two pieces of aluminum foil to simulate the conditions under which the foil is heat treated. After annealing at 400° C. in a furnace with air circulating in it, the force of adhesion between the pieces of foil, the size of a drop of water on the foil surface and the degree of staining determined visually.

The following classification system is used to determine the degree of staining:

4=pronounced staining
3=staining
2=mild staining
1=recognizable discoloring due to residues
0=no discoloring To carry out heat treatment test No 2 a drop of lubricant is placed on a foil in which a recess has been made, and the foil then heat treated at 400° C. This test is always carried out on a pair of such samples, one sample being heat treated in a furnace with air circulating in it, the other in a nitrogen atmosphere.

The results of these trials are also presented in table II, the assessment of the degree of staining being the same as in heat treatment test No. 1.

Table II

| Lubricant | Heat treatment test No. 1 adhesive force g/44.4 mm | drop test ϕ mm | Staining | Heat treatment test No. 2 Staining in air | Staining (in $N_2$) |
|---|---|---|---|---|---|
| Palmseed oil | >30 | — | 4 | 4 | 4 |
| 10% Palmseed oil in Kerosene | 3.5 | 7 | 0 | 0 | 3 |
| Product A | 34 | — | 4 | 4 | 4 |
| 10% Product A in Kerosene | 0.2 | 7 | 0 | 0 | 4 |
| Product B | 9.4 | 4.5 | 3 | 4 | 0 |
| 10% Product B in Kerosene | 2.8 | 7 | 0 | 1 | 0 |
| Cylinder oil | >30 | — | 4 | 4 | 1 |
| 10% Cylinder oil in Kerosene | 3.5 | 6 | 0 | 0 | 1 |
| Product C | 0.1 | 12 | 0 | 3 | 1 |
| 10% Product C in Kerosene | 0.1 | 12 | 0 | 0 | 0 |
| Product D | <0.1 | 12 | 0 | 4 | 1 |
| 10% Product D in Kerosene | <0.1 | 11 | 0 | 0 | 0 |
| INDOPOL H 100 | 0 | 12 | 0 | 3 | 0 |
| 10% INDOPOL in Kerosene | 0 | 12 | 0 | 0 | 0 |
| 6461 | 0.02 | 13 | 0 | 1 | 0 |
| 10% 6461 in Kerosene | 0.02 | 13 | 0 | 0 | 0 |
| 4661 | 0.02 | 15 | 0 | 2 | 0 |
| 10% 4661 in Kerosene | 0.02 | 15 | 0 | 1 | 0 |
| 4662 | 0.02 | 12 | 0 | 1 | 0 |
| 10% 4662 in Kerosene | 0.02 | 11 | 0 | 1 | 0 |
| 4663 | 0.02 | 12 | 0 | 3 | 0–1 |
| 10% 4663 in Kerosene | 0.02 | 11 | 0 | 3 | 0–1 |
| 4664 | 0.02 | 12 | 0 | 4 | 0–1 |
| 10% 4664 in Kerosene | 0.02 | 11 | 0 | 4 | 0–1 |
| 4665 | 0.02 | 12 | 0 | 4 | 0–1 |
| 10% 4665 in Kerosene | 0.02 | 11 | 0 | 4 | 0–1 |
| 4666 | 0.02 | 11 | 0 | 2 | 0 |
| 10% 4666 in Kerosene | 0.02 | 12 | 0 | 2 | 0 |
| 556 V | 2.6 | 15 | 0 | 4 | 1 |
| 10% 556 V in Kerosene | 0.09 | 15 | 0 | 4 | 1 |
| Petrol | 0 | 12 | 0 | 0 | 0 |

The results of the wear test (RV-test) by Baist at 60° C. are given in table III. Steel pins, 1700 μm long and 5 mm in diameter were employed for this test. The area of pin under load was 12.6 $mm^2$.

The column headed "start of fines" gives the load in kg/12.6 $mm^2$ at which the first steel fines were observed. In the column headed "start of friction", the load at which the first rubbing occured. The limit was taken as the load at which the first "cold weld spots" appeared, at which stage the electrical conductivity of the film of lubricant had fallen to such a low value that it could be assumed that locally a complete break down in the lubricant film had occured. The column "end of friction" gives information about the point at which the limiting load is reached.

The comparison of the results from the lubricant of the invention and the commercially available product A shows clearly the superior performance of the lubricant of the invention in that the beakdown of the lubricant film does not occur until higher loads are reached.

Table III

| Lubricant | start fines (kg) | start friction (kg) | end limiting load (kg) | end resistance (Ω) | end friction (kg) |
|---|---|---|---|---|---|
| Product A | 140 | 40 | 230 | 1 | 25 |
| 6461 | 110 | 60 | 310 | 2 | 30 |
| 4661 | 50 | 150 | 540 | 0.5 | 20 |
| 4662 | 50 | 80 | 290 | 0 | 30 |
| 4663 | 100 | 100 | 290 | 0 | 30 |
| 4664 | 50 | 50 | 310 | 0.5 | 30 |
| 4665 | 90 | 90 | 380 | 0 | 30 |
| 4666 | 70 | 70 | 430 | 0.5 | 30 |
| 556 V | 20 | 50 | 350 | 0 | 20 |

I claim:

1. A synthetic bearing lubricant in which 100 parts by weight of the lubricant contain:

86.9 to 97.5 parts by weight of poly-isobutene;

2.1 to 11.2 parts by weight of at least one ester of a $C_2$ to $C_5$ alcohol with an α-hydroxy-monocarboxylic acid or an α-hydroxy-dicarboxylic acid; and 0.4 to 1.9 parts by weight of at least a single or multiple-unsaturated $C_{13}$– to $C_{19}$- carboxylic acid.

2. A bearing lubricant according to claim 1 in which 100 parts by weight of lubricant contain 91.5 to 95.3 parts by weight of poly-isobutene, 3.7 to 7.5 parts by weight of at least one ester of a $C_2$ $C_5$ alcohol with said α-hydroxy carboxylic acid, and 0.6 to 1.2 parts by weight of at least one of said unsaturated $C_{13}$–$C_{19}$ carboxylic acid.

3. A bearing lubricant according to claim 1 in which a mixture of at least two poly-isobutenes with different chain lengths are used as the poly-isobutene.

4. A bearing lubricant according to claim 1 in which the poly-isobutene is at least in part replaced by polymethylmethacrylate dissolved in mineral oil.

5. A bearing lubricant according to claim 4 in which the mineral oil containing the poly-methylmethacrylate to replace the poly-isobutene, is mixed with kerosene.

6. A bearing lubricant according to claim 5 in which the ratio of mineral oil containing poly-methylmethacrylate to kerosene lies between 2:1 and 1.2.

7. A bearing lubricant according to claim 6 in which the ratio of mineral oil containing poly-methylmethacrylate to kerosene lies between 1.2:1 and 1:1.2.

8. A bearing lubricant according to claim 1 in which the esters used are those whose alcohol component is an alcohol selected from the group consisting of ethanol, propanol, butanol and pentanol and the acid component is an acid selected from the group consisting of hydroxy acetic acid, lactic acid, malic acid and tartaric acid.

9. A bearing lubricant according to claim 1 in which the ester is selected from the group consisting of ethanol hydroxy acetate, propanol hydroxy acetate, butanol hydroxy acetate, lactic acid ethyl ester, lactic acid propyl ester, lactic acid butyl ester, malic acid butyl ester, tartaric acid dibutyl ester, and 3-hydroxy butyric acid ethyl ester.

10. A roll bearing lubricant according to claim 1 in which the single or polyunsaturated $C_{13}$ to $C_{19}$ acids are selected from the group consisting of oleic acid, linoleic acid and linolenic acid.

11. A bearing lubricant according to claim 1 in which the grade of individual components used are purified grade.

* * * * *

UNITED STATES PATENT AND TRADEMARK OFFICE

CERTIFICATE OF CORRECTION

PATENT NO. : 4,151,102

DATED : April 24, 1979

INVENTOR(S) : Rudolf Baur

It is certified that error appears in the above-identified patent and that said Letters Patent are hereby corrected as shown below:

Column 4, line 2, change '"pure" grade.' to read ---grade "pure" (purum or purified).---.

Column 7, line 6, claim 6, change "1.2" to read ---1:2---.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*